US008042308B2

(12) United States Patent
Sullivan et al.

(10) Patent No.: US 8,042,308 B2
(45) Date of Patent: Oct. 25, 2011

(54) WALL PANEL SYSTEM

(75) Inventors: Scott L. Sullivan, Palo Alto, CA (US); Hee-seung Chung, San Francisco, CA (US)

(73) Assignee: Williams-Sonoma, Inc., San Francisco, CA (US)

( * ) Notice: Subject to any disclaimer, the term of this patent is extended or adjusted under 35 U.S.C. 154(b) by 958 days.

(21) Appl. No.: 11/517,723

(22) Filed: Sep. 9, 2006

(65) Prior Publication Data

US 2008/0120922 A1 May 29, 2008

(51) Int. Cl.
*E04B 2/30* (2006.01)

(52) U.S. Cl. ..... 52/238.1; 52/483.1; 52/DIG. 4; 434/74; 434/408

(58) Field of Classification Search ..... 52/506, 52/DIG. 4, 239, 293.3, 223.6, 46, 586.1, 52/483.1, 771–772, 238.1; 248/683, 467, 248/206.5, 309.4, 220.21, 220.22, 223.41, 248/225.11, 490; 428/455; 434/73, 408
See application file for complete search history.

(56) References Cited

U.S. PATENT DOCUMENTS 3,168,787 A * 2/1965 Surrey ..... 40/585
3,363,871 A * 1/1968 Slazik et al. ..... 248/451
3,982,370 A * 9/1976 Buffington ..... 52/481.2
4,287,676 A * 9/1981 Weinhaus ..... 40/661.01
4,487,586 A * 12/1984 Palmans ..... 434/408
4,934,119 A * 6/1990 Ybarra ..... 52/238.1
5,295,342 A * 3/1994 Roche et al. ..... 52/764
6,328,571 B1 * 12/2001 Dricken et al. ..... 434/408
6,962,016 B1 * 11/2005 Meyer ..... 40/757
7,147,196 B2 * 12/2006 Knight et al. ..... 248/490
2006/0183101 A1 * 8/2006 Williams et al. ..... 434/408

* cited by examiner

*Primary Examiner* — Brian Glessner
*Assistant Examiner* — James Buckle, Jr.
(74) *Attorney, Agent, or Firm* — Bay Area Technology Law Group PC

(57) ABSTRACT

A system for releasably attaching a panel to a wall. The panel is provided with a front surface intended to be visible to an observer once the panel has been installed upon the wall at a rear surface opposite the front surface supporting a plurality of magnets. A corresponding plurality of brackets are attached to the wall and positioned such that when the panel is properly positioned upon the wall, the panel is releasably secured thereto by causing the plurality of magnets to be secured to the plurality of brackets. The panels can abut one another to create a variety of useful surfaces such as peg-board, corkboard, chalkboard, fabric and magnetic bulletin boards. The brackets can be oriented to obscure them from a viewer and can also be reoriented to provide a releasable attachment means for a frame to surround the panels for a more finished, aesthetic appearance.

18 Claims, 4 Drawing Sheets

WALL PANEL SYSTEM

TECHNICAL FIELD

The present invention is directed to a system for releasably attaching one or more panels to a wall. These panels can provide a variety of surfaces, such as pegboard, corkboard, chalkboard, fabric or magnetic bulletin board/dry erase board surfaces in order to expand the aesthetics and utility of such a wall panel system. Through the creative use of a universal bracket capable of being installed in various orientations to a wall and through the use of magnets properly positioned on the various wall panel members, the system of the present invention can provide an easy to install and aesthetically pleasing utilitarian wall panel system unmatched by prior efforts in this field.

BACKGROUND OF THE INVENTION

It is quite common to apply decorative and functional panels to a wall for a multitude of reasons. Teenagers and preteens, for example, are constantly "customizing" their environments by tacking memorabilia and messages onto walls to create a sense of individuality. Many people adhere chalkboards, pegboards or bulletin boards to walls acting as functional reminders as an adjunct to a diary or "to do list."

There are commercially available bulletin boards having means for attaching them to walls. Many of such commercially available articles employ adhesives or tapes as attachment means and they are virtually all intended to be used as stand alone objects, unrelated to decorative or functional articles surrounding them.

There have also been attempts to create systems whereby a plurality of panels are installed upon a supporting wall in order to expand the aesthetic and functional opportunities available from using but a single panel item. These systems are composed of panels that are generally mounted by hanging panels individually so that together they form an array. Again, within the array various panels could possess and provide to a user different functions such as a chalkboard, pegboard, dry-erase/magnetic board, push-pin (fabric) board and corkboard. Those familiar with such systems recognize the advantages presented by such a multi-panel array. However, these wall systems have not been universally embraced because such systems tend to be aesthetically unpleasing, not to mention the fact that installation is quite difficult.

As an example, it has been common to apply multiple panels to walls by including two keyhole fasteners on each panel so that each panel could be mounted to a wall surface independent of adjacent panels. Square or rectangular panels could create square or rectangular arrays which could have been "finished" by applying a frame to the overall peripheral edge of the multi-panel array. However, where mounting one panel posed no significant problem, mounting more than two of these panels with the use of the prior keyhole fasteners made panel alignment virtually impossible. Further, the relief of each panel as extending from the wall surface could not be made uniform from panel to panel, again creating an aesthetically unattractive array. Additionally, because prior panels employ two keyhole fasteners per panel, users would be required to drill and insert up to 40 wall anchors to attach a 4×4 array with a surrounding frame. Because the frame employed by the prior art was attached to the wall separately from the array of panels themselves, alignment between the frame and panels was virtually impossible. The end result was that any error made to any panel in the prior art array was immediately apparent as adjacent panels become comparative viewing references. For example, if one prior panel was an ⅛" off level, it would stand out in such an array; and the prior system further did not "float" and could not be later adjusted.

It is thus an object of the present invention to provide a wall panel system which is not characterized with the disadvantages as described above.

Yet a further object of the present invention is to provide a wall panel system in which panel members can be releasably appended to a wall employing a universal mounting bracket which can take on different orientations and in which any panel misalignment can be readily corrected to present an aesthetically pleasing as well as functional system unavailable by practicing the prior art.

These and further advantages will be more readily apparent when considering the following disclosure and appended claims.

SUMMARY OF THE INVENTION

The present invention involves a system for selectively and releasably attaching one or more panels to a wall using magnets and magnetically-attractive brackets. The system comprises a panel having a front surface which is visible to an observer (once the panel has been installed on the wall) and an opposing rear surface. A select number of magnets are attached to the rear surface of the panel. A select number of brackets are secured to the wall in such a manner that each bracket aligns and selectively magnetically engages with a corresponding magnet of a panel. Each bracket includes a formed ledge that is sized and shaped to support the weight of the corresponding panel. The magnetic attraction between the bracket and the magnet of the panel is used to ensure that the panel remains on the formed ledge. In this manner, the magnets must be only strong enough to hold the panel horizontally against the bracket but magnetic attraction does not have to support the weight of each corresponding panel. Once mounted to the brackets, each panel may be easily removed therefrom by simply pulling to overcome the relatively weak strength of the magnets. The magnets allow any mounted panels to be slightly adjusted so that the panels effectively "float" in place on their respective brackets. In addition to being oriented to hold a bracket against the wall, each bracket is further shaped to function as a panel to panel holding clip, and also includes a feature that allows a surrounding frame to be attached to a completed and mounted panel array.

DETAILED DESCRIPTION OF THE INVENTION

Figure 1:
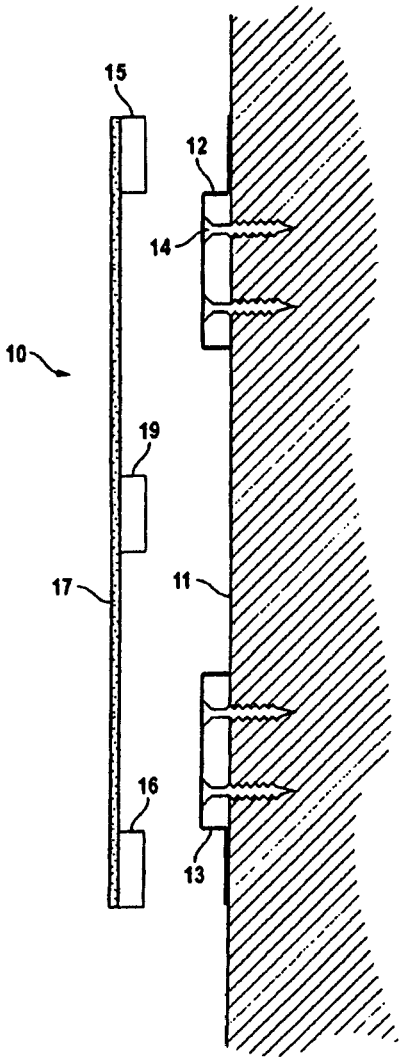
FIG. 1 is a side view showing a portion of the wall panel system of the present invention.

Turning first to FIG. 1, a first embodiment to the present invention is shown in partial cross section. Specifically, FIG. 1 illustrates the installation of a single panel member 10 upon wall 11 employing brackets 12 and 13. Panel 10, once installed, provides an observer with a front surface 17 which can be a number of appropriate embodiments such as a pegboard, corkboard, chalkboard, fabric, magnetic bulletin board or magnetic/dry erase board.

Figure 5A:
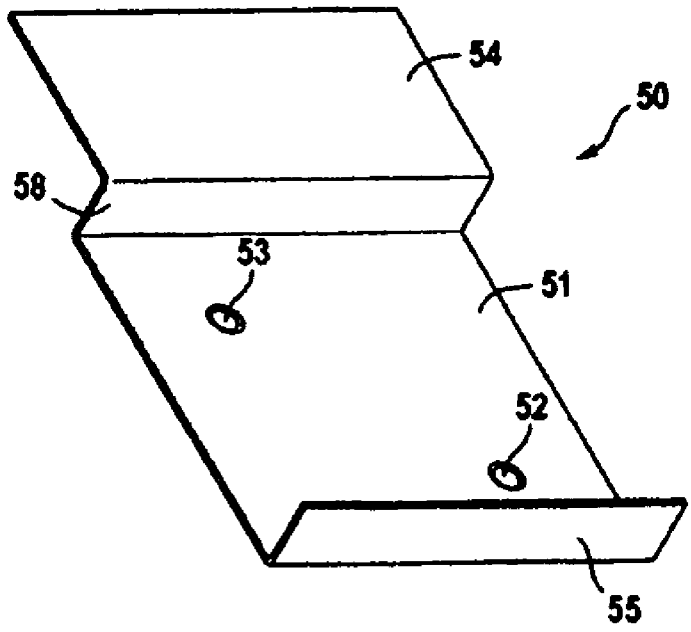
FIGS. 5*a* and 5*b* are perspective views of a bracket useful in practicing the present invention.
Figure 5B:
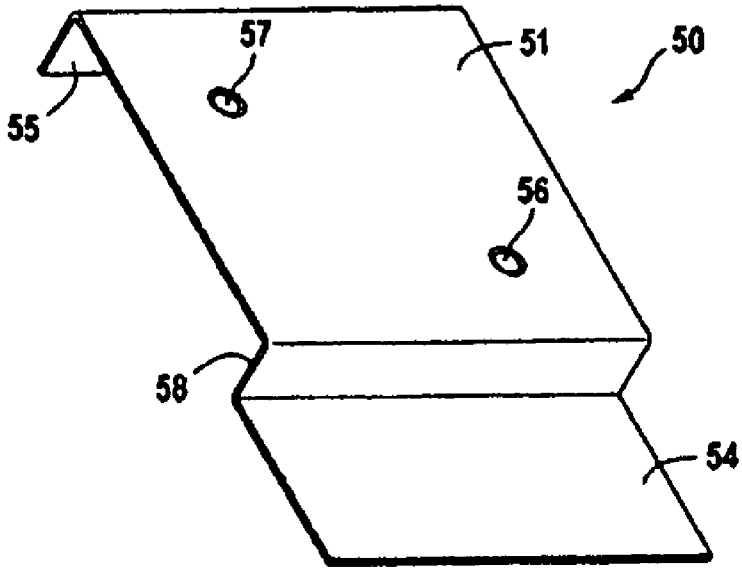

Turning back to FIG. 1, the wall hanging system of the present invention is depicted as the application of single panel 10 onto wall 11. The process of installation begins with the application of brackets 12 and 13 in the orientation as shown. The brackets themselves are best visualized by reference to FIGS. 5*a* and 5*b* showing brackets 50 in two different orientations so that their front and back faces can be seen. Brackets 50 are produced by stamping metal stock having a relatively short planar region 54, relatively large planar region 51, ledge 58 and upturned lip 55. Holes 52, 53, 56 and 57 are configured within relatively large planar region 51, each hole being a counter sunk where it is intended that screws pass therethrough for attachment to wall 11. In this regard, reference is made once again to FIG. 1 showing screws 14 employed to retain brackets 12 and 13 onto wall 11. Panel 10 is prepared having magnets 15 positioned at the rear surface thereof. When panel 10 is rectangular or square, magnets 15 will be placed at the center of each of the four linear boundaries that constitute the periphery of panel 10. In side view, magnets 15, 16 and 19 are shown.

In installing panel 10 onto wall 11, brackets 12 and 13 are first applied to wall 11 in the appropriate position to receive magnets 15 and 16. For simplicity only brackets 12 and 13 are shown, obviously brackets would also be installed to receive magnet 19 (and the magnet on an edge of panel 10 obscured from view by magnet 19). In a single panel installation, without a frame, it is intended that panel 10 be applied to wall 11 without any portion of brackets 12 or 13 being visible. This is accomplished by positioning brackets 12 and 13 as shown which receive magnets 15 and 16, respectively in areas 54 (FIGS. 5*a*-5*b*). Thus, all of brackets 12 and 13 are obscured by panel 10 once properly positioned. The panel 10 is maintained by ledge 58 (FIGS. 5A and 5B) supporting magnets 15 and 16.

Certain advantages in practicing the present invention become readily apparent from the above discussion. It is first noted that panel 10 can be applied to wall 11 quickly and conveniently by the mere magnetic positioning of panel 10 onto supporting metal brackets. If a panel was to be slightly misaligned with respect to other wall features or other panels, correction can be made readily without the need to remove and reestablish the positioning of any hardware as the panels float on their respective supporting brackets. Also, the nature of panel 10 can be changed readily and conveniently. For example, if corkboard was applied to wall 11 and it was later decided to remove it to install a fabric fascia as a decorative item or as a receiving surface for pin attachments, this again can be done readily and conveniently.

Figure 2:
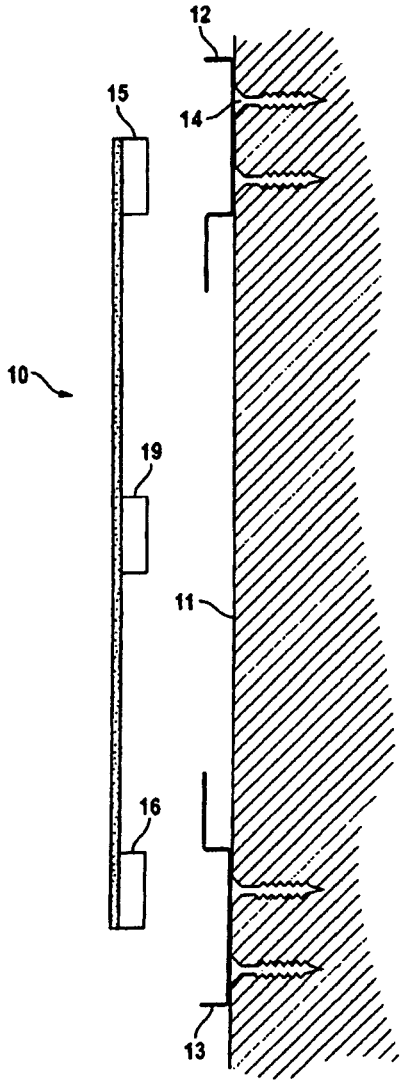
FIG. 2 is a side view of a second embodiment of the wall panel system of the present invention.
Figure 3:
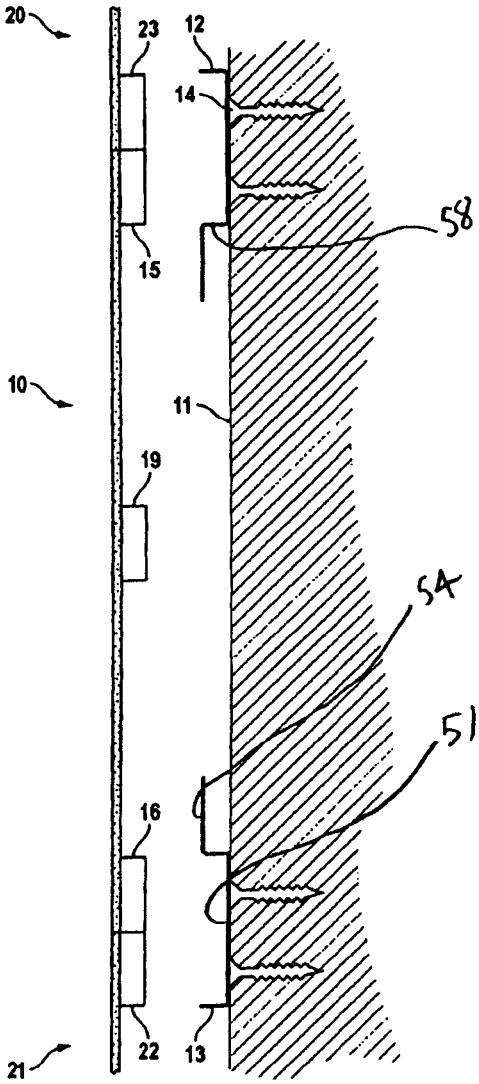
FIG. 3 is a side view of the embodiment of FIG. 2 showing a second panel being joined thereto.
Figure 4:
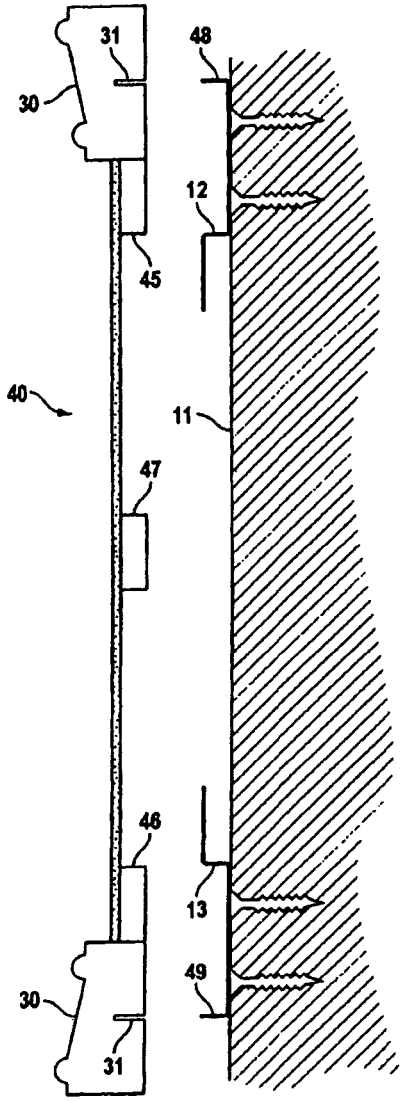
FIG. 4 is a side view of the embodiment of FIG. 2 further showing the installation of a frame about a suitable panel.

Reference is next made to FIGS. 2, 3 and 4 showing multi-panel and framing installations. In this regard, it is noted that brackets 12 and 13 have been flipped and inverted so that region 51 of the brackets is now flush against wall 11 employing screws 14 as shown. Panel 10 is again placed upon brackets 12 and 13 to enable magnets 15 and 16 to engage the brackets and to be held in place by ledge 58 and by upturned lip 55 (FIGS. 5A and 5B). Now, however, as illustrated in FIG. 3, second panels 21 and magnet 22 can be joined to panel 10 making a multi-panel array by nesting not only magnets 15 and 16 of panel 10 within brackets 12 and 13, respectively, but also magnet 23 of panel 20 and magnet 22 of panel 21, all within brackets 12 and 13 and all physically supported in region 51 between ledge 58 and upturned lip 55. One is now able to create a multi-panel array without the repositioning of any hardware items. It is further noted that if panel 10 had to be repositioned or its orientation adjusted, this could be done by placing slight finger pressure upon lip 55 (FIGS. 5*a* and 5*b*) causing a disruption in the magnetic attraction between magnets 15 and 16 and their respective brackets.

In order to provide a somewhat finished appearance to the multi-panel array shown being constructed in FIGS. 2 and 3, a frame can be applied to the outside of its peripheral edge. In this regard, reference is made to FIG. 4 whereby panel 40, contemplated as an outside panel in a multi-panel array is shown having properly positioned magnets 45, 46 and 47, the former two being applied to brackets 12 and 13 as previously described. In that no further panels are intended to be applied to the peripheral edges of panel 40, portions of brackets 12 and 13 remained exposed including lips 48 and 49 (corresponding to lip 55 of FIGS. 5*a* and 5*b*). In completing the structure, a frame 30 can be constructed from parts to have an inner frame dimension substantially equivalent to the dimension of the outside peripheral edge of the appropriately constructed multi-panel array. Frame 30 includes a slot 31 configured within its back surface sized and positioned to receive upturned lips 48/49. As a result, frame 30 is frictionally held against the perimeter of the multi-panel array providing a finished look to the system. In doing so, one could readily remove frame 30 and continue adding panel members as described with reference to FIGS. 2 and 3 providing further flexibility to the present invention.

Figure 6A:
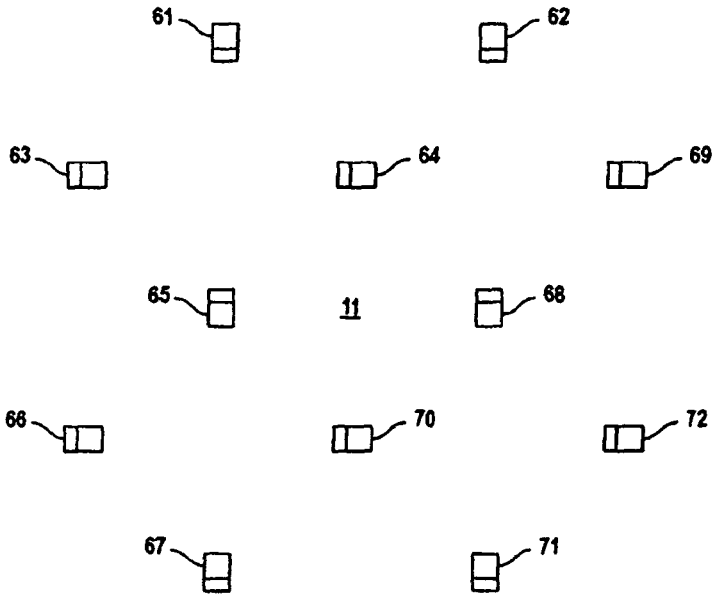
FIGS. 6*a* through 6*c* show, in front plan view, the installation of a multi-panel system pursuant to the present invention.
Figure 6B:
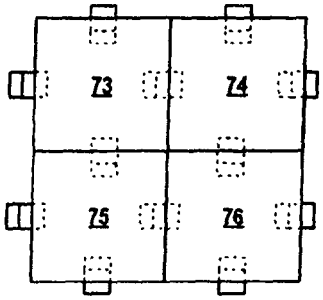
Figure 6C:
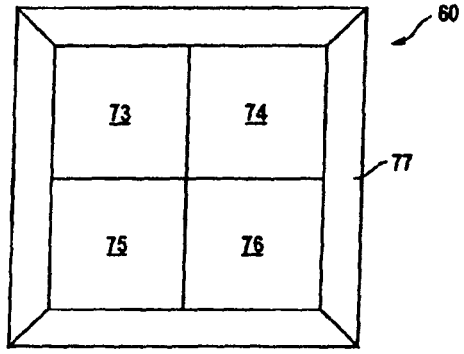

Construction of a suitable wall panel system can be more readily visualized in reference to FIGS. 6*a* through 6*c*. One would begin by appropriately positioning and installing, by screw attachment, brackets 61 through 72 (FIG. 6*a*). Each bracket is positioned to mate with magnets positioned at the mid-points of the peripheral edges of rectangular or square panel members as discussed previously. Thus, the array as shown in FIG. 6*a* is established.

Once brackets 61 through 72 have been applied to wall 11, panel member 73-76 are then magnetically positioned thereon (FIG. 6*b*). As noted previously, if one of these panels is slightly misaligned, its position can be altered to provide a more uniform and aesthetically pleasing visual appearance. This can further be facilitated by applying slight finger pressure to upturned lip 55 (FIG. 5*a*). To complete the look, frame 77 can be applied to the periphery of panel member 73 through 76 resulting in the completion of wall system 60. Frame 77 is applied to outwardly extending brackets as discussed in detail with regard to FIG. 4. As a consequence, one has now achieved a wall panel system which can be altered easily to change wall panel members, to fine tune their orientation and to do so without engaging in laborious hardware alteration.

The invention claimed is:

1. A system for releasably attaching a panel to a wall, said system comprising a panel, and a plurality of brackets, each bracket having a ledge and lip, said panel having a front surface intended to be visible to an observer when said panel has been installed upon said wall and a rear surface opposite said front surface, a plurality of magnets attached to said rear surface, said plurality of brackets being attached to said wall, such that once said panel is properly positioned upon said wall, said magnets would reside between said ledge and upturned lip and are supported thereby to enable said panel to be releasably secured to and in contact with said brackets by causing each of said plurality of magnets be magnetically positioned between said ledge and upturned lip such that either said ledge or upturned lip substantially support the weight of said panel.

2. The system of claim 1 wherein said panel is square or rectangular and said plurality of magnets are positioned at the mid-points and proximate the edges of each of the four sides of said panel.

3. The system of claim 1 wherein said brackets are configured to be attached to said wall in two orientations, a first orientation being such that when said panel is releasably attached thereto, no portion of said bracket extends beyond an edge of said panel and a secondary orientation being such that when said panel is releasably attached thereto, a portion of said bracket extends beyond the edge of said panel.

4. The system of claim 3 wherein said bracket is attached to said wall in said first orientation and said system comprises only a single panel.

5. The system of claim 4 wherein the front surface of said panel comprises a member selected from the group consisting of a pegboard, corkboard, chalkboard, fabric and magnetic bulletin/dry erase board.

6. The system of claim 3 wherein a plurality of equally sized rectangular or square panels comprise said system, each panel having magnets positioned at the mid-points and proximate each of said edges, said panels being attached to said wall by abutting edges thereof in forming a single rectangular or square multi-panel array having a peripheral edge wherein at said peripheral edge, said brackets are in said first orientation and at said abutting edges said brackets are in said second orientation.

7. The system of claim 6 wherein said magnets located along said abutting edges of adjacent panels are positioned between said ledge and upturned lip of single brackets configured in said second orientation.

8. The system of claim 3 wherein a plurality of equally sized rectangular or square panels comprise said system, each panel having magnets positioned at the mid-points and proximate each of said edges, said panels being attached to said wall by abutting edges thereof and forming a singular rectangular or square multi-panel array having a peripheral edge, wherein said brackets being in said second orientation both at said abutting edges and at said peripheral edge such that edges of adjacent panels abut each other and a portion of each of said brackets extends beyond said peripheral edge.

9. The system of claim 8 further comprising a frame member, said frame member being sized to extend outside of said peripheral edge, said frame removably maintained on said wall by engaging the portion of said brackets that extend beyond said peripheral edge.

10. The system of claim 9 wherein said upturned lip extending substantially perpendicularly from said wall and beyond said peripheral edge engages a slotted back surface of said frame for receiving said upturned lip for releasably retaining said frame thereon.

11. The system of claim 1 wherein said brackets comprise rectangularly-shaped metal stock having a plurality of holes configured therein for receiving a plurality of screws for releasably securing said brackets to said wall.

12. The system of claim 1 wherein the magnetic attraction between magnets and brackets being substantially lessened by flexing said upturned lip.

13. A system for releasably attaching a plurality of equally sized rectangular or square panels to a wall, said system comprising said panels and a plurality of brackets, each bracket having a ledge and upturned lip, each of said panels having a front surface intended to be visible to an observer when said panels have been installed upon said wall and a rear surface opposite said front surface, a plurality of magnets attached to the rear surfaces of each said panels, said plurality of brackets being attached to said wall and positioned such that when said panels are properly positioned upon said wall, said panels are releasably secured thereto by positioning said plurality of magnets within said brackets and secured to and separated by said plurality of brackets between the ledge and upturned lip of each bracket, said panels being attached to said wall by abutting edges thereof and forming a single rectangular or square multi-panel array having a peripheral edge, wherein said brackets being located at said abutting edges and at said peripheral edge.

14. The system of claim 13 wherein said brackets are configured to be attached to said wall in two orientations, a first orientation being such that when said panels are releasably attached thereto, a portion of said brackets at said peripheral edge do not extend beyond said peripheral edge and a second orientation being such that when said panels are releasably secured thereto, a portion of said brackets at said peripheral edge extend beyond said peripheral edge.

15. The system of claim 14 wherein said brackets are attached to said wall in said second orientation at said peripheral edge, said system further comprising a frame member, said frame member being sized to extend outside of said peripheral edge, said frame removably maintained on said wall by engaging the portion of said brackets that extend beyond said peripheral edge.

16. The system of claim 15 wherein the portion of said brackets that extend beyond said peripheral edge comprises an upturned lip extending substantially perpendicularly from said wall, said frame having a slotted back surface for receiving said upturned lip for releasably retaining said frame thereon.

17. The system of claim 16 wherein the front surface of said panels comprise one or more members selected from the group consisting of pegboard, corkboard, chalkboard, fabric and magnetic bulletin/dry erase board.

18. The system of claim 13 wherein said brackets are sized and positioned to snuggly receive said plurality of magnets at the abutting edges of adjacent panels between said ledge and upturned lip.

* * * * *